United States Patent [19]

Sato et al.

[11] 4,437,907

[45] Mar. 20, 1984

[54] AMORPHOUS ALLOY FOR USE AS A CORE

[75] Inventors: Takashi Sato; Tsutomu Ozawa, both of Kawasaki, Japan

[73] Assignee: Nippon Steel Corporation, Tokyo, Japan

[21] Appl. No.: 355,241

[22] Filed: Mar. 5, 1982

[30] Foreign Application Priority Data

Mar. 6, 1981 [JP] Japan ..... 56-32345

[51] Int. Cl.[3] ..... H01F 1/04

[52] U.S. Cl. ..... 148/31.55; 148/121; 148/108; 75/123 B; 75/123 L

[58] Field of Search ..... 75/123 B, 123 L, 123 LB; 148/31.55, 102, 103, 108, 121

[56] References Cited

U.S. PATENT DOCUMENTS 3,856,513 12/1974 Chen et al. ..... 75/122
4,219,355 8/1980 DeCristofaro et al. ..... 75/123 L
4,268,325 5/1981 O'Handley et al. ..... 148/108

FOREIGN PATENT DOCUMENTS 54-109428 8/1979 Japan .
54-148122 11/1979 Japan .
55-158251 12/1980 Japan .

*Primary Examiner*—John P. Sheehan
*Attorney, Agent, or Firm*—Kenyon & Kenyon

[57] ABSTRACT

Amorphous alloys have attractive properties which make possible their use as cores for transformers, these properties being a low watt loss, which is due to an inherently low magnetic anisotropy, and a high resistivity. However, one of the most serious disadvantages of amorphous alloys is the low thermal stability of the magnetic properties and the fact that their magnetic properties, such as saturation flux density (Bs), decrease at the temperature of the energized or excited core.

In order to eliminate the disadvantages of the known amorphous alloys, the present invention proposes an amorphous alloy having a composition of $Fe_{74-80}Si_{8-19}B_{6-13}C_{0-3.5}$. This alloy is specifically adapted so that it can be used as a transformer core which can be energized or excited at a high flux density.

17 Claims, No Drawings

AMORPHOUS ALLOY FOR USE AS A CORE

The present invention relates to an amorphous alloy for use as the core of electric-power transforming machines and devices, such as a power transformer, a current transformer, a high frequency current transformer, a reactor, and the like. More particularly, the present invention relates to an improvement of an amorphous alloy composition so as to decrease the watt loss and the change in the magnetic properties depending upon the temperature and to increase the thermal stability of the amorphous structure and magnetic properties.

The thermal stability of the amorphous structure herein indicates the resistance of the amorphous structure to crystallization. The thermal stability of the magnetic properties herein indicates the resistance of watt loss and magnetic flux density to aging. The change in the magnetic properties depending upon the temperature indicates herein a deterioration of saturation induction or a decrease in the saturation flux density (Bs) when the temperature is increased from room temperature to a high temperature, for example the core being energized or operated.

A low watt loss and a good exciting characteristic are the principal magnetic properties required for materials for use as the core mentioned above. The watt loss is identical to the electric power which is loss as heat in the core, which is energized or excited by an alternating current, and such a loss of electric power day and night all over the world allegedly is a huge amount. The heat generated due to watt loss results in elevation of the temperature of the core, which, in the case of a high frequency current transformer, results in various limitations of the design of such transformer, e.g. only limited kinds of core materials can be used and the magnetic flux density for energizing or exciting such transformer is limited.

The material presently used as the cores of electric-power transforming machines and devices include silicon steel sheets, thin silicon steel strips, ferrite, Permalloy, iron powder, and the like, one of which is selected according to how it can be applied in the case of specific types of electric-power transforming machines and devices. In other words, it is virtually impossible to select from the conventional materials one material which is both economical and satisfies the properties required for the various types of electric-power transforming machines and devices.

According to a recently developed process, an alloy which has a random or nonperiodic structure like glass and is thus referred to as an amorphous alloy can be obtained in sheet or strip form by very rapidly cooling a molten alloy. Amorphous alloys have attracted attention because they have no magnetic anisotropy in principle, can have a high electric resistance if their compositions are appropriate, and can be easily obtained in a thin form so that watt loss is low over a broad frequency range and the exciting characteristics is excellent. Amorphous alloys are, however, defective in the respect that their saturation flux density (Bs) is considerably lower than that of silicon steel sheets and is too low for amorphous alloys to be used as the core of a power transformer. Also, the thermal stability of their magnetic properties and amorphous structure is very low and change in the magnetic properties depending upon the temperature is disadvantageously high. Amorphous metals therefore involve practical problems when they are considered for use as the cores of electric-power transforming machines and devices. Therefore, various proposals have been made as to how to improve the composition of an amorphous alloy and thereby enhance the saturation flux density. For example, Japanese laid-open patent application No. 55-152150 discloses an amorphous alloy having a composition of 11~17% B-3~8% C-Fe (the Fe being balanced with the rest of the composition) with the proviso that the total percentage of boron and carbon falls within the range of from 18 to 21%. In addition, Japanese laid-open patent application No. 55-158251 (U.S. patent application Ser. No. 42,472) discloses an amorphous alloy composition of 80~82% Fe-12.5~14.5% B-2.5~5.0% Si-1.5~2.5% C. Furthermore, Japanese laid-open patent application No. 54-148122 (U.S. patent application Ser. No. 898,482) discloses an amorphous alloy composition of 80~84% Fe-12~15% B-1~8% Si. In this Japanese laid-open patent application, merely the magnetostriction is disclosed and the other magnetic properties required for the core are not described.

Although it is well known that the amorphous alloy described in U.S. Pat. No. 3,856,513 has an amorphous structure with a high thermal stability, no magnetic properties are mentioned at all.

The amorphous alloys known from the above-mentioned Japanese laid-open patent applications exhibit, however, a saturation flux density (Bs) at room temperature which slightly exceeds 17 KG and thus does not amount to the level of 20 KG in the case of silicon steels. Furthermore, of the known amorphous alloys with compositions such that the alloys can achieve a high saturation flux density (Bs) at room temperature, such flux density (Bs) is decreased to a high degree at the temperature of the core being excited or energized (70°-150° C). The thus decreased saturation flux density (Bs) is from approximately 15 to 16 KG so that the saturation flux density (Bs) at the temperature of the core is decreased more than that at room temperature. In other words, the difference in the saturation flux density (Bs) between amorphous alloys and silicon steels is increased by an elevation in temperature. The amorphous alloys known from the above-mentioned Japanese laid-open patent applications are disadvantageously thermally unstable. So that an amorphous alloy for use as the core of electric-power transforming machines and devices can be practically applied, it is very advantageous to develop an alloy composition in which one of the characteristics of the amorphous alloy, i.e. low watt loss, is maintained or is further improved and the common disadvantage of the amorphous alloy, i.e. low thermal stability of the magnetic properties, is decreased or virtually eliminated. From such a point of view, the present inventors investigated various amorphous alloy compositions in regard to their magnetic properties and thermal stability and discovered that in the case of an alloy with a specific alloy composition, the watt loss of the alloy and the change in the magnetic properties depending upon the temperature are very low and the thermal stability of the amorphous structure and magnetic properties is simultaneously very high. More specifically, in the case of said alloy with a specific composition, the alloy is provided with a very high thermal stability and, simultaneously, with a low watt loss by means of an annealing. In other words, an amorphous alloy having a composition such that the amorphous structure has a high thermal stability can be subjected to an annealing at a temperature higher than that at which an amorphous alloy having a composition such that the amorphous structure has a low thermal stability can be subjected to an annealing, with the result that the watt loss of the former amorphous alloy is improved, which technique was unknown in the prior art and was discovered by the present inventors.

It is an object of the present invention to provide an amorphous alloy for use as the core of electric-power transforming machines and devices, said alloy having a low watt loss and a high thermal stability in regard to the magnetic properties and amorphous structure.

It is a specific object of the present invention to provide an amorphous alloy exhibiting a small change in the saturation flux density (Bs) depending upon the temperature.

It is another specific object of the present invention to provide an amorphous alloy capable of being specifically adapted for use as the core of a transformer excited or energized at a high flux density.

The present invention involves a novel concept in the respect that: (1) the watt loss and thermal stability of the magnetic properties as well as a small change in the saturation flux density (Bs) depending upon the temperature, are the most important properties of an amorphous alloy for use as the core of a transformer excited or energized, particularly at a high magnetic flux density of, for example, from 12 to 14 KG; (2) even if the saturation flux density (Bs) at room temperature is relatively low, the decrease in the flux density at the temperature of said core being operated or energized should be slight, e.g. from 4 to 5%; (3) virtually removing all of the strain from the amorphous alloy after plastic deformation and the strain induced by winding of the core, is important from a practical point of view; (4) enhancing the resistance of the amorphous structure to crystallization stabilizes the amorphous structure; (5) the aging of watt loss is suppressed; and (6) providing said alloy with ductility. This concept, which is not at all considered in the prior art, is explained in detail hereinbelow.

In accordance with the objects of the present invention, there is provided an amorphous alloy for use as the core of electric-power transforming machines and devices, wherein said alloy has an essentially amorphous structure, an extremely low watt loss, a small change in the magnetic properties depending upon the temperature, and a high thermal stability in respect to the magnetic properties and amorphous structure and is composed of the chemical formula of $Fe_aSi_bB_cC_d$, said parameters a, b, c, and d being the following atomic percentages:

a=from 74 to 80%
b=from 8 to 19%
c=from 6 to 13%
d=from 0 to 3.5% with the proviso that a+b+c+d=100%.

The composition of the amorphous alloy according to the present invention differs from that known from the above-mentioned Japanese laid-open patent applications, and the significance of such difference lies in the fact that the low watt loss and excellent thermal stability of the amorphous structure and magnetic properties, particularly the watt loss, and small change in the saturation flux density (Bs) depending upon the temperature, are simultaneously achieved in accordance with the present invention. On the other hand, in Japanese laid-open patent application No. 55-152150, the alloy has such a composition that a high saturation flux density (Bs) at room temperature can be achieved but a high thermal stability cannot be achieved. In Japanese Laid-open Patent Application No. 55-158251, the iron content is relatively high so as to make low magnetostriction possible. The amorphous alloy in a sheet form can be easily handled or wound without causing its rupture.

According to preferable compositions of the present invention, one or more, or desirably all, of the components Fe, Si, and C of the alloy are limited to the following corresponding range: an iron percentage (a) of from 76 to 79%; a silicon percentage (b) of from 8 to 17%; and a carbon percentage (d) of from 0 to 2.0%. An example of these preferable compositions is $Fe_{78}Si_{10}B_{10}C_2$.

It is more preferable to restrict the total percentage of boron and carbon so that it falls within the range of from 6 to less than 10% ($6 \leqq c+d < 10$).

According to more preferable compositions of the present invention, one or more, advantageously all, of silicon, boron, and carbon are limited to the following corresponding range: a silicon percentage (b) of from 8 to 13%; a boron percentage (c) of from 7 to 9.9%; and a carbon percentage (d) of from 0.5 to 2.0%. The boron percentage (c) is more preferably 9.5% or less. The ductility of amorphous alloy is particularly high at the boron percentage (c) of 9.9% or 9.5% at the maximum.

Advantageous specific amorphous alloys according to the present invention have compositions of $Fe_{78}Si_{13}B_8C_1$ and $Fe_{78}Si_{12}B_9C_1$.

The characteristics of the amorphous alloy according to the present invention are: (1) a low amount of watt loss and a high thermal stability in respect to the amorphous structure and magnetic properties, particularly in respect to the watt loss, these characteristics being superior to those of known amorphous alloys having a high saturation flux density (Bs); and, (2) the exciting characteristic is good, because a saturation flux density (Bs) or magnetic flux density at the temperature of the energized or excited core is comparable to that of said known amorphous alloys. According to the high thermal stability of the magnetic properties, the increase in watt loss after aging is very low and can be less than 10% in terms of:

$$\frac{W_{12.6/50}\text{ after aging} - W_{12.6/50}\text{ before aging}}{W_{12.6/50}\text{ before aging}} \times 100\%,$$

said aging being carried out at 200° C. for 2000 hours. In addition, the decrease in magnetic flux density in terms of $B_1$ due to said aging does not exceed 3%.

One of the reasons for the above-mentioned low watt loss is that the iron content and the metalloid element (B, Si, and C, especially B and C) content of the present invention are lower and higher, respectively, than those of known amorphous alloys having a high saturation flux density (Bs). An amorphous alloy is usually produced in the form of a sheet by means of a liquid quenching method. The strain induced in the amorphous alloy during the production process cannot be relieved satisfactorily by annealing the alloy at a low temperature. Thus, the watt loss of the amorphous alloy tends to be either enhanced or impaired, and the strain is retained in the alloy. The strain is induced in the amorphous alloy, for example, during cooling at the molten state and during the production of a wound core having a toroidal form, said core usually being made of a thin strip of magnetic material. In such a case, the strain, which is inversely proportional to the diameter of the wound core, is applied to the thin strip, and therefore the watt loss of such a core appreciably increases as compared with that of the thin strip before winding. More specifically, the wound core exhibits a watt loss and an exciting power (rms VA) a few times greater than those of a sample in the form of a single sheet used as a laboratory test specimen, in which sheet no external strain is applied. However, in the present invention the increase in watt loss due to the winding of a thin strip is lower than and is not as serious as in the case of the prior art and is advantageous in comparison with that occuring in known amorphous alloys having a high saturation flux density (Bs). Therefore, annealing of the amorphous alloy is indispensable for providing this alloy with a low watt loss. Since the temperature for initiating crystallization of the amorphous alloy according to the present invention is considerably higher than that of such conventional alloys, a higher annealing temperature can be employed for the former alloy, thereby allowing satisfactory removal of the strain retained after cooling of the alloy melt and winding of the core. The annealing temperature can be up to 430° C. according to the present invention while in the known amorphous alloys having a high saturation flux density (Bs), the annealing temperature cannot exceed approximately 385° C., as is disclosed in Japanese laid-open patent application No. 55-158251.

This increase in watt loss is very advantageous not only in the production of a wound core but also in the production of a laminated core because the amorphous alloy is subjected to stress during the production of both cores.

The composition of the amorphous alloy according to the present invention, particularly the lower iron content and higher metalloid element content as compared with the known amorphous alloys having a high saturation flux density (Bs), realizes an easy vitrification at a relatively low cooling rate of the alloy melt. This means that a thick strip of amorphous alloy having, for example, a thickness of from 10 to 50 m can be produced, thereby lessening, from a practical point of view, one of the present disadvantages of the iron-based amorphous alloys, i.e. a thin thickness. Due to the low cooling rate mentioned above, the strain retained in the amorphous alloy of the present invention after the alloy has been cooled can be maintained at a low level, which is assumed to be one of the reasons why watt loss is very low in said alloy.

The method for producing the amorphous alloy according to the present invention may be either of the following known continuous production methods: (1) a single roll or centrifugal quenching method in which the alloy in the molten state is subjected to and impinged on the outer or inner wall of a rotating roll or drum and (2) a double roll method in which the alloy in the molten state is quenched between a pair of rolls by withdrawing heat from both surfaces of the alloy.

The resultant strip usually cannot have satisfactory magnetic properties in the resultant or as-cast state, and therefore the resultant strip is subjected to annealing at a temperature lower than the temperature for initiating crystallization so as to improve its magnetic properties. Annealing is desirably carried out while applying a magnetic flux or tension to the strip, thereby achieving a greater improvement in the magnetic properties. No matter how the magnetic flux or tension is or is not applied to the strip during annealing, annealing is more effective for the amorphous alloy of the present invention than for the known amorphous alloys having a high saturation flux density (Bs). The amorphous alloy according to the present invention may be subjected to annealing at a temperature of from 350° to 430° C. in a magnetic field higher than the coercive force of the alloy. The amorphous alloy according to the present invention may be subjected to annealing at a temperature of from 385° to 410° C. with the application of a magnetic field.

The present invention is explained hereinafter by way of examples.

EXAMPLE 1

The starting materials were admixed with each other so as to prepare alloy having the composition of $Fe_{78}Si_{10}B_{10}C_2$. After melting of the starting materials, the melt was quenched from 1100° C., which is a temperature 100° C. higher than the liquidus temperature, by means of a single cooling roll made of steel, on the surface of which the melt was impinged. The resultant strips had a width of 20 mm, and each strip produced from one charge of the starting materials weighed about 300 grams. The resultant strip was annealed at a temperature of 390° C. for 30 minutes in a magnetic field (30 Oe) in a hydrogen atmosphere. the watt loss ($W_{12.6/50}$) and magnetic flux density ($B_1$) were measured in regard to a specimen of the resultant annealed strip and a specimen aged at 200° C. for 2000 hours. The watt loss was measured by means of a single sheet tester.

$W_{12.6/50}$ indicates watt loss (watt/kg) at a frequency of 50 $H_3$ and a magnetic flux density of 12.6 KG. $B_1$ indicates magnetic blux density at room temperature and magnetic field of 1 Oe.

The results were as follows.

The resultant annealed strip had a $W_{12.6/50}$ of 0.063 (watt/kg) and a $B_1$ of 14.7 KG, while the aged strip had a $W_{12.6/50}$ of 0.064 (watt/kg) and a $B_1$ of 14.5 KG. The percentage of increase in $W_{12.6/50}$ and the percentage of decrease in $B_1$ due to aging was 1.6% and 1.4%, respectively.

EXAMPLE 2

The procedure in Example 1 was repeated regarding the compositions given in Table 1 except that the quenching temperature of the melt was 50° C. higher than the liquidus temperature. Annealing of the strips falling with the composition range of the present invention was carried out at a temperature of from 385° to 410° C. for 30 minutes in a magnetic field of 30 Oe, and the resultant strips not falling within the composition range of the present invention were annealed at 375° C. for 30 minutes in a magnetic field. The watt loss ($W_{12.6/50}$) was measured regarding single specimens having a dimension of 20 mm in width and 120 mm in length and wound cores in a toroidal form having a dimension of 20 mm in width and 60 mm in diameter. The temperature for initiating crystallization was measured by means of a differential thermoanalyzer (DTA) at a temperature elevation rate of 10° C./min.

TABLE 1

| | Watt Loss $W_{12.6/50}$ |
|---|---|

TABLE 1-continued

| Composition | Watt Loss $W_{12.6/50}$ Single Sheet | Watt Loss $W_{12.6/50}$ Toroidal | Watt Loss Increase (%) | (Single Sheet) After Aging at 200° C. for 2000 hours | (Single Sheet) Percentage of Increase (%) | $B_1$ (KG) Single Sheet | $B_1$ (KG) Toroidal |
|---|---|---|---|---|---|---|---|
| Invention | | | | | | | |
| 1. $Fe_{76}Si_{16}B_7C_1$ | 0.078 | 0.090 | 115 | 0.083 | 6.0 | 14.5 | 14.2 |
| 2. $Fe_{76}Si_{16}B_8$ | 0.082 | 0.090 | 110 | 0.086 | 4.9 | 14.3 | 14.1 |
| 3. $Fe_{76}Si_{11}B_{12}C_1$ | 0.056 | 0.065 | 130 | 0.059 | 5.4 | 14.6 | 14.3 |
| 4. $Fe_{77}Si_{13.5}B_9C_{0.5}$ | 0.062 | 0.072 | 116 | 0.065 | 4.8 | 14.6 | 14.0 |
| 5. $Fe_{78}Si_{13}B_8C_1$ | 0.081 | 0.090 | 111 | 0.085 | 4.9 | 14.9 | 14.7 |
| 6. $Fe_{78}Si_{12}B_9C_1$ | 0.076 | 0.086 | 113 | 0.079 | 3.9 | 15.0 | 14.7 |
| 7. $Fe_{78}Si_{11}B_9C_2$ | 0.082 | 0.096 | 117 | 0.086 | 4.6 | 15.1 | 14.7 |
| 8. $Fe_{78}Si_{10}B_9C_3$ | 0.092 | 0.106 | 116 | 0.097 | 5.4 | 15.2 | 15.0 |
| 9. $Fe_{79}Si_{10}B_{10}C_1$ | 0.086 | 0.101 | 117 | 0.087 | 1.2 | 15.2 | 14.9 |
| Comparative Samples | | | | | | | |
| 10. $Fe_{81}Si_{3.5}B_{13}C_{2.5}$ | 0.103 | 0.132 | 128 | 0.119 | 15.5 | 15.3 | 14.8 |
| 11. $Fe_{82}Si_4B_{12}C_2$ | 0.121 | 0.159 | 131 | 0.140 | 15.7 | 14.8 | 14.3 |
| 12. $Fe_{82}Si_4B_{14}$ | 0.156 | 0.216 | 138 | 0.176 | 12.8 | 14.2 | 13.6 |

| Composition | $B_s$ (KG) Room Temperature | $B_s$ (KG) 100° C. | $B_s$ Decrease (KG) | $B_s$ Decrease (%) | Temperature for Initiating Crystallization (°C.) | Crystallization Peak Temperature (°C.) |
|---|---|---|---|---|---|---|
| Invention | | | | | | |
| 1. $Fe_{76}Si_{16}B_7C_1$ | 15.0 | 14.3 | 0.7 | 4.7 | 499 | 518 |
| 2. $Fe_{76}Si_{16}B_8$ | 14.9 | 14.2 | 0.7 | 4.7 | 500 | 520 |
| 3. $Fe_{76}Si_{11}B_{12}C_1$ | 15.2 | 14.5 | 0.7 | 4.6 | 511 | 533 |
| 4. $Fe_{77}Si_{13.5}B_9C_{0.5}$ | 15.4 | 14.6 | 0.8 | 5.2 | 502 | 521 |
| 5. $Fe_{78}Si_{13}B_8C_1$ | 15.5 | 14.6 | 1.1 | 7.1 | 495 | 513 |
| 6. $Fe_{78}Si_{12}B_9C_1$ | 15.6 | 14.8 | 0.8 | 5.1 | 489 | 518 |
| 7. $Fe_{78}Si_{11}B_9C_2$ | 15.7 | 14.9 | 0.8 | 5.1 | 499 | 526 |
| 8. $Fe_{78}Si_{10}B_9C_3$ | 15.7 | 14.9 | 0.8 | 5.1 | 495 | 520 |
| 9. $Fe_{79}Si_{10}B_{10}C_1$ | 15.9 | 15.0 | 0.9 | 5.7 | 506 | 528 |
| Comparative Samples | | | | | | |
| 10. $Fe_{81}Si_{3.5}B_{13}C_{2.5}$ | 16.6 | 15.5 | 1.1 | 6.6 | 479 | 499 |
| 11. $Fe_{82}Si_4B_{12}C_2$ | 16.4 | 15.4 | 1.0 | 6.1 | 459 | 490 |
| 12. $Fe_{82}Si_4B_{14}$ | 16.6 | 15.4 | 1.2 | 7.2 | 465 | 492 |

The increase in watt loss is calculated as follows:

$$\frac{W_{12.6/50\ (toroidal)} - W_{12.6/50\ (single\ sheet)}}{W_{12.6/50\ (single\ sheet)}} \times 10(\%)$$

The decrease in Bs is calculated as follows:

$$\left| \frac{Bs_{(100°\ C.)} - Bs_{(room\ temperature)}}{Bs_{(room\ temperature)}} \right| \times 100(\%)$$

The following features of the present invention are apparent from Table 1, and it can be concluded that the watt loss and the thermal stability of the magnetic properties and crystal structure are improved by the present invention as compared to the prior art:

1. The watt loss of single sheets and wound cores in a toroidal form is low.

2. The increase in watt loss due to winding of the core does not exceed 130% in all of the samples and does not exceed 120% in most of the samples.

3. The increase in watt loss due to aging does not exceed 10%.

4. The decrease in the saturation flux density (Bs) does not exceed 6.0% in all of the samples and does not exceed approximately 5.0% in most of the samples.

5. The temperature for initiating crystallization is higher than approximately 490° C.

6. The magnetic flux density ($B_1$) of the present invention is not appreciably different from that of the comparative compositions.

We claim:

1. An annealed amorphous alloy for use as the core of electric-power transforming machines and devices, wherein said annealed alloy has an essentially amorphous structure, an extremely low watt loss, a high thermal stability in respect to the magnetic properties and amorphous structure, a small change in the magnetic properties depending upon the temperature, and exhibits a very low increase in watt loss and a very low decrease in magnetic flux density after aging, and is composed of the chemical formula of $Fe_aSi_bB_cC_d$, said parameters a, b, c, and d being the following atomic percentages:

a=from 74 to 79%
b=from 10 to 19%
c=from 6 to 13%
d=from 0 to 3.5% with the proviso that a+b+c+d=100%;

wherein the decrease in magnetic flux density after annealing in terms of:

$$\frac{B_1 \text{ after said aging} - B_1 \text{ before said aging}}{B_1 \text{ before said aging}} \times 100(\%)$$

does not exceed 3%, and, wherein said alloy is annealed at a temperature of from 350° to 430° C. in a magnetic field higher than the coercive force of said alloy.

2. An alloy according to claim 1 wherein said annealing temperature is higher than 385° C.

3. An amorphous alloy according to claim 1 or 2 wherein the iron percentage (a) is from 76 to 79%.

4. An amorphous alloy according to claim 1 or 2 wherein the silicon percentage (b) is from 10 to 17%.

5. An amorphous alloy according to claim 3 wherein the silicon percentage (b) is from 10 to 13%.

6. An amorphous alloy according to claim 5 wherein the boron percentage (c) is from 7 to 9.9%.

7. An amorphous alloy according to claim 3 wherein the carbon percentage (d) is from 0 to 2.0%.

8. An amorphous alloy according to claim 1 or 2 wherein the carbon percentage is from 0.5 to 2.0%.

9. An amorphous alloy according to claim 1 or 2 wherein said alloy is composed of $Fe_{78}Si_{10}B_{10}C_2$.

10. An amorphous alloy according to claim 7 wherein the boron percentage (c) is from 7 to 9.9%.

11. An amorphous alloy according to claim 4 wherein the carbon percentage (d) is from 0 to 2.0%.

12. An amorphous alloy according to claim 6 wherein the carbon percentage (d) is from 0.5 to 2.0%.

13. An amorphous alloy according to claim 1 or 2, wherein the silicon content (b) is from 10 to 13%, the boron content (c) is from 7 to 9.9%, and the carbon content (d) is from 0.5 to 2.0%.

14. An amorphous alloy according to claim 1 or 2 wherein said alloy is composed of $Fe_{78}Si_{13}B_8C_1$.

15. An amorphous alloy according to claim 1 wherein said alloy is composed of $Fe_{78}Si_{12}B_9C_1$.

16. An amorphous alloy according to claim 1 or 2 wherein the increase in watt loss ($W_{12.6/50}$) after annealing in terms of:

$$\frac{W_{12.6/50}\text{ after aging at 200° C. for 2000 hours} - W_{12.6/50}\text{ before said aging}}{W_{12.6/50}\text{ before said aging}} \times 100(\%)$$

does not exceed 10%.

17. An amorphous alloy according to claim 2 wherein said alloy is annealed at a temperature of up to 410° C. with the application of a magnetic field.

* * * * *